United States Patent [19]

Luthi et al.

[11] 4,435,085

[45] Mar. 6, 1984

[54] MIXER FOR USE IN PULP PROCESSES

[75] Inventors: Oscar Luthi, Nashua; Lawrence A. Carlsmith, Amherst, both of N.H.

[73] Assignee: Ingersoll-Rand Company, Woodcliff Lake, N.J.

[21] Appl. No.: 406,112

[22] Filed: Aug. 6, 1982

[51] Int. Cl.[3] ..... B01F 15/02; B01F 5/14

[52] U.S. Cl. ..... 366/155; 241/28; 241/261.2; 366/176

[58] Field of Search ..... 366/155, 263, 302, 303, 366/177, 176, 150, 154; 241/28, 261.2, 261.3; 162/246

[56] References Cited

U.S. PATENT DOCUMENTS

| | | | |
|---|---|---|---|
| 3,552,664 | 1/1971 | Herbert | 241/261.3 |
| 3,984,057 | 10/1976 | Pilao | 241/261.3 X |
| 4,036,443 | 7/1977 | Saltarelli | 241/261.2 X |
| 4,081,147 | 3/1978 | Seifert et al. | 241/261.3 |
| 4,303,207 | 12/1981 | Lindström | 241/261.2 |

FOREIGN PATENT DOCUMENTS

| | | | |
|---|---|---|---|
| 240419 | 8/1962 | Australia | 162/246 |

*Primary Examiner*—Robert W. Jenkins
*Attorney, Agent, or Firm*—F. S. Troidl

[57] ABSTRACT

Pulp and oxygen are mixed by feeding the pulp and also feeding the oxygen to a mixer which has a grooved rotor closely spaced between two grooved discs to provide high intensity mixing zones.

10 Claims, 4 Drawing Figures

MIXER FOR USE IN PULP PROCESSES

This invention relates to the pulp and paper industry. More particularly, this invention is a high shear mixer for mixing pulp at medium consistency with a bleaching agent such as oxygen gas.

Two important operations in mixing pulp wih oxygen are (1) oxygen distribution and (2) turbulent mixing. The oxygen must be evenly distributed in a small mixing chamber. The mixing operation is most intense if the mixing zone is a small volume. Thus, for optimum mixing a narrow high-shear gap is desirable which provides intense mixing.

There are currently available different types of mixers for mixing pulp and oxygen. Many of these mixers have a narrow high-shear gap. Unfortunately, pulp always contains some unwanted tramp metal. This tramp metal causes problems if not removed and can severely damage a mixer requiring shut down of the system and expensive repair. A high speed rotor, for example, cannot be stopped in time if a piece of tramp metal is wedged between the rotor and the housing. The mixer will be destroyed.

Thus, a mixer for mixing pulp with a bleaching agent, such as oxygen, provides evenly distributed oxygen and a high-shear gap for intense mixing and which permits the removal of the tramp metal is highly desirable. This invention provides such a mixer.

Briefly described the invention comprises a generally cylindrical housing with a pulp inlet and a pulp outlet. At least one bleaching agent inlet is provided. A rotor is co-axially mounted within the housing. The rotor has a wheel with radially extending grooves. The grooves are located in the pulp flow path between the pulp inlet and the pulp outlet. At least a part of the radial portion of the wheel with the radial grooves define with a part of the housing an annular space. The annular space provides an intense mixing zone.

The invention as well as its many advantages may be further understood by reference to the following detailed description and drawings in which.

In the various figures like parts are referred to by like numbers.

Figure 1:
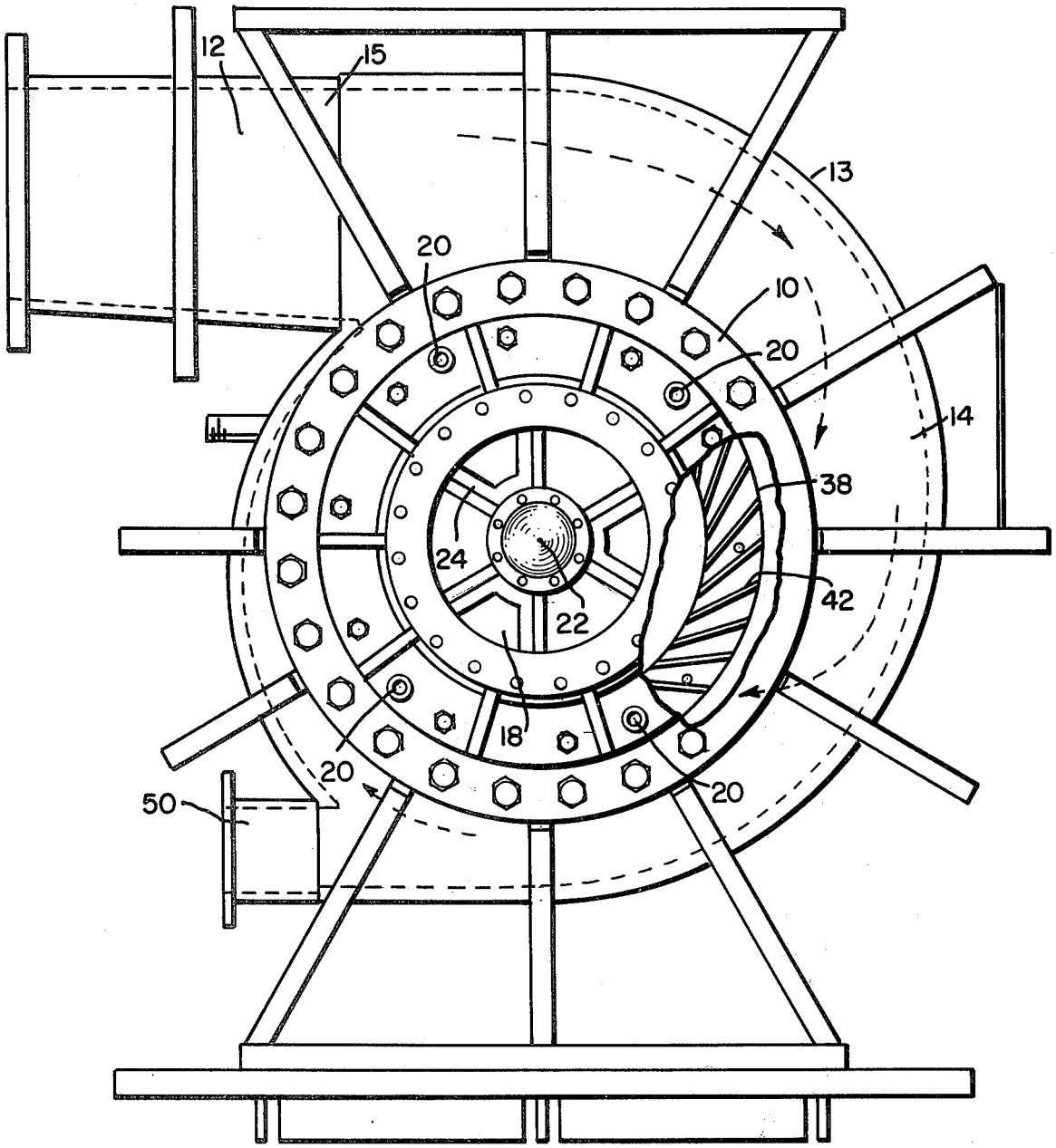
FIG. 1 is a front view, partly in section, of a preferred embodiment of the invention.
Figure 2:
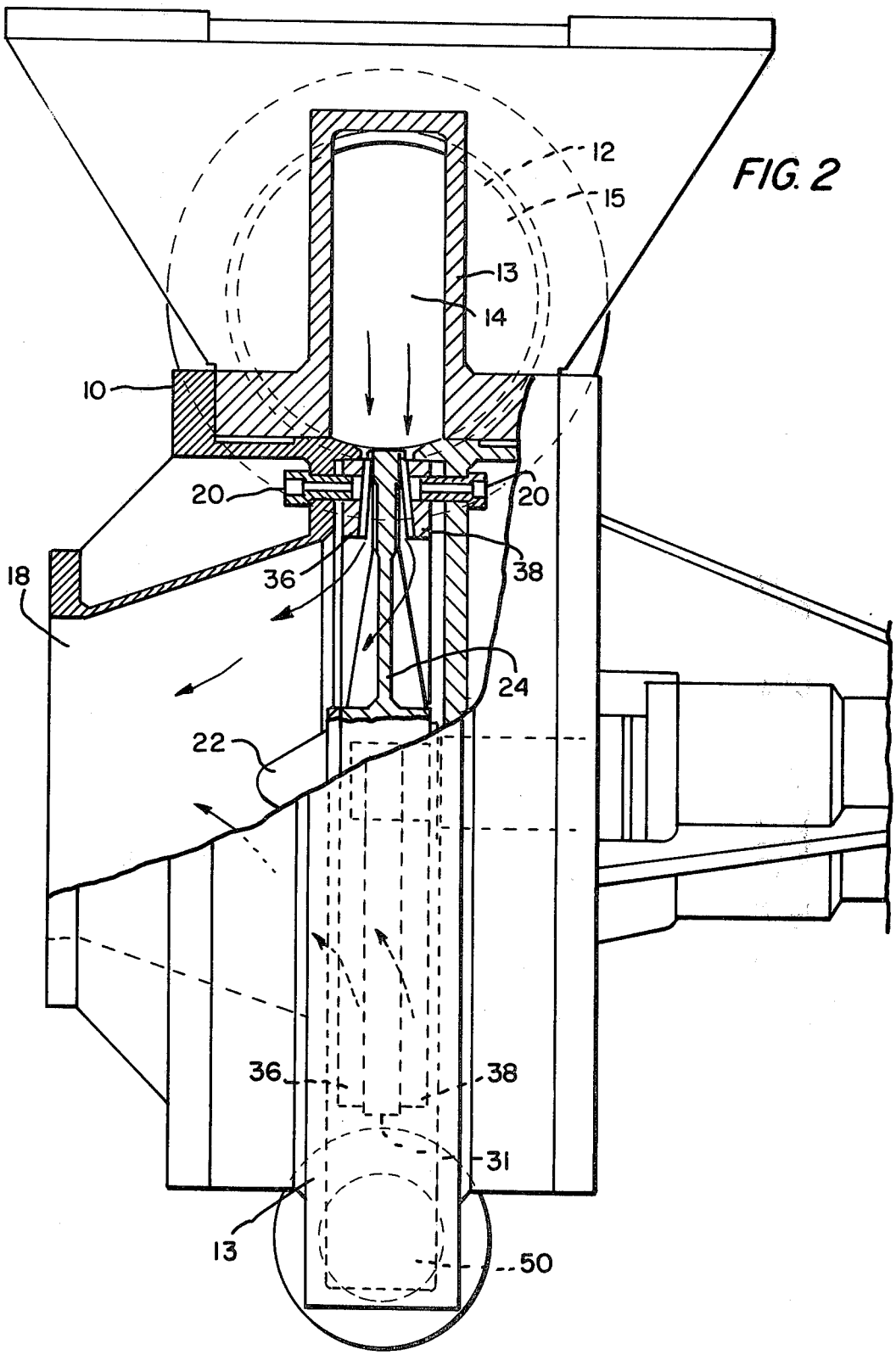
FIG. 2 is a side view, partly in section, of the preferred embodiment of FIG. 1.

Referring to the drawings and more particularly to FIG. 1 and FIG. 2, the mixer includes a generally cylindrical housing 10. A pulp inlet 12 is used for feeding the pulp tangentially into the housing 10. The pulp which enters pulp inlet 12 is fed to volute 13. The channel 14 between housing 10 and the outside of volute 13 progressively decreases radially as it progresses from the entrance 15 of the volute 13 circumferentially around the housing 10.

Referring to FIG. 2 the pulp mixed with oxygen leaves the housing 10 through co-axial pulp outlet 18. The oxygen is fed to the housing by means of at least one and preferably a plurality of circumferentially spaced bleaching agent inlets 20 in housing 10.

Figure 3:
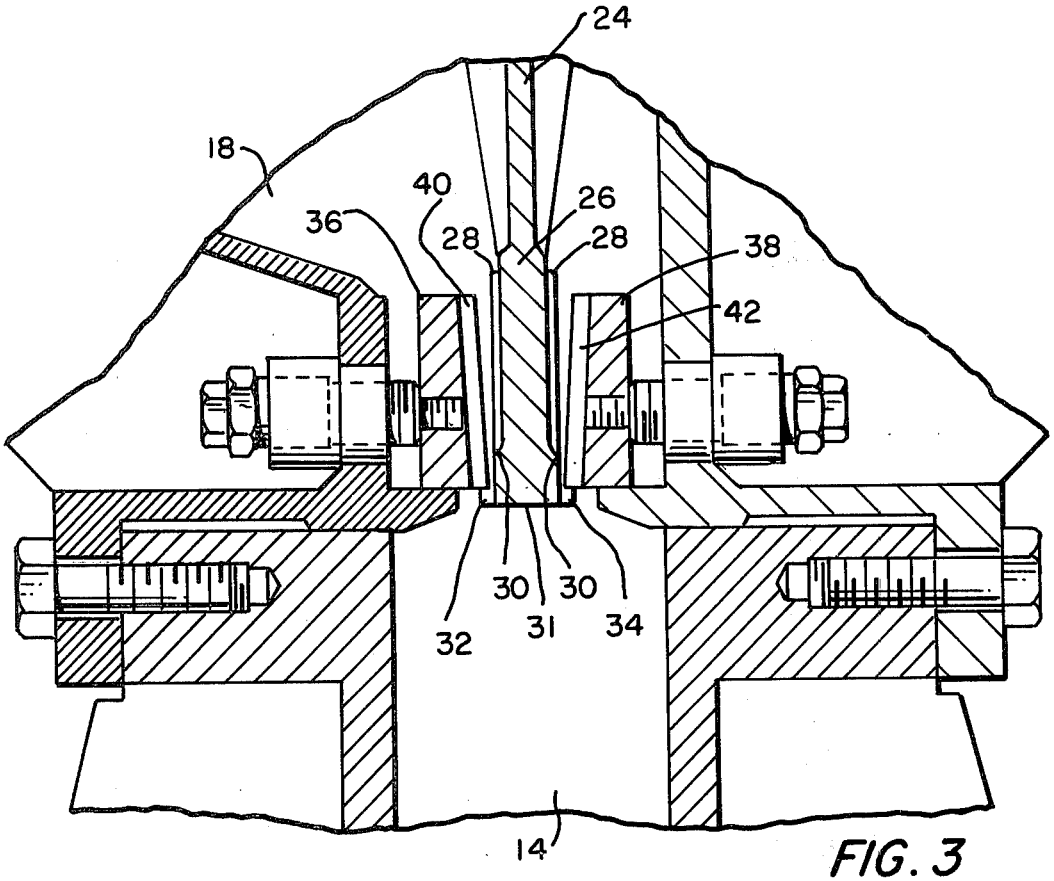
FIG. 3 is a sectional view on an enlarged scale of the grooved portion of the rotor and the grooved discs of the preferred embodiment.

A rotor 22 with a spoked wheel 24 is co-axially mounted within the housing 10. Referring to FIG. 3 the wheel rim 26 is provided with radially extending grooves 28 on each side surface. The grooves 28 extend from the inside of the rim partially across the rim 26 and terminate at points 30 spaced radially inwardly from the outside surface 31 of the rim.

Annular rings 32 and 34 extend axially from each side of the outer portion of the rim 26. The radius of the inside of each ring 32 and 34 is substantially the same as the outside radius of the annular discs 36 and 38. A plurality of circumferentially spaced grooves extend through each ring 32 and 34.

Figure 4:
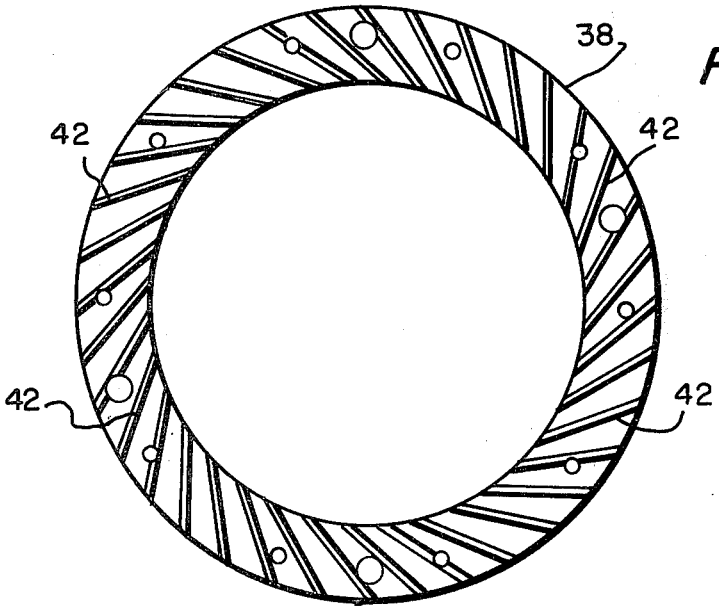
FIG. 4 is a front view of one of the discs of the preferred embodiment.

The annular discs 36 and 38 are each provided with circular spaced grooves 40 and 42, respectively. The discs 36 and 38 taper radially inwardly. The grooves 40 and 42 have the same depth throughout their lengths. Referring to FIG. 4 the grooves 42 on annular disc 38 slant backward with respect to the direction of the pulp flow. Though not shown in FIG. 4, the grooves 40 on disc 36 (see FIG. 3) also slant backward with respect to the direction of the pulp flow.

In operation, pulp enters the volute housing and moves in the direction shown by the arrow of FIG. 1. As the pulp moves through space 14, the pulp flow must progressively contract toward the outside diameter of rotor 22. The backward slant of the annular disc grooves provides for the easy flow of the pulp through the grooves. Any tramp metal in the pulp will be freed from the pulp fibers in the turbulent zone in space 14 near the rim outside surface 31 and then flung towards the outside of the channel 14. The tramp metal will collect at the bottom part of the channel 14 and is intermittently removed through tramp metal outlet 50.

The rotor grooves 28 tend to accelerate the pulp radially outwardly. However, since the grooves terminate short of the outside surface of the rim, a high intensity mixing zone is provided which causes radial recirculation which is superimposed on the large tangential pulp feed velocity. The tapered annular discs minimize back flow into the volute housing. The spacing of the discs 36 and 38 from the wheel rim, of course, may be made adjustable to suit operating conditions.

The oxygen inlet 20 extend through discs 36 and 38 into the high intensity mixing zones. Since the oxygen is introduced into the high intensity zone, uniform distribution of the oxygen is assured by the large radial circulation even if only one inlet is used per disc.

We claim:

1. A mixer for mixing pulp with a bleaching agent comprising: a generally cylindrical housing; a pulp inlet adapted to feed pulp into the housing; a pulp outlet; a rotor coaxially mounted within the housing, said rotor having a wheel having radially extending grooves which are located in the pulp flow path between the pulp inlet and the pulp outlet, at least a part of the radial portion of the wheel with the radial grooves defining with a part of the housing an annular high intensity mixing zone; and at least one bleaching agent inlet located so that intensive mixing of the bleaching agent and pulp will occur in the high intensity mixing zone, whereby the pulp flows from the pulp inlet, through the annular high intensity mixing zone, and out the pulp outlet.

2. A mixer in accordance with claim 1 wherein: radially extending grooves are located on both sides of the wheel; and there are two axially spaced grooved discs in the housing between which the wheel is closely spaced a predetermined axial distance to provide annular high intensity mixing zones.

3. A mixer in accordance with claim 2 wherein: the discs are annular discs, with each disc having grooves on the surface facing the wheel.

4. A mixer in accordance with claim 3 wherein: the wheel is a spoked wheel with the radial grooves extending from the inside of the rim partially across the rim; and the annular disc grooves extend entirely across the annular discs.

5. A mixer in accordance with claim 4 wherein: the annular discs are radially inwardly tapered, and the depth of each annular disc groove is constant throughout its length.

6. A mixer in accordance with claim 5 wherein: the pulp outlet has the same axis as the housing, and the rotor; and the wheel has annular rings extending axially from each side of the outer portion of the rim, the radius of the inside of each ring being substantially the same as the outside radius of the annular discs, each ring having a plurality of radially extending grooves extending therethough.

7. A mixer in accordance with claim 6 wherein: the grooves in the annular discs slant backward with respect to the direction of the pulp flow.

8. A mixer in accordance with claim 7 wherein: there are a plurality of bleaching agent inlets extending axially through each annular disc into each high intensity mixing zone.

9. A mixer for mixing pulp with a bleaching agent comprising: a housing; a rotor mounted in the housing, said rotor having radially extending grooves and cooperating with said housing to form a high intensity mixing zone adjacent said radially extending grooves; a pulp inlet located in said housing radially outwardly of said high intensity mixing zone and communicating therewith; bleaching agent inlet means for feeding the bleaching agent into the housing, said bleaching agent inlet means being located so that intensive mixing of the bleaching agent and the pulp will occur in the high intensity mixing zone; and a pulp outlet located radially inwardly of the high intensity mixing zone.

10. A mixer in accordance with claim 9 wherein: the bleaching agent inlet means is located to feed the bleaching agent directly into the high intensity mixing zone.

* * * * *